US010253971B2

(12) United States Patent
Rao et al.

(10) Patent No.: US 10,253,971 B2
(45) Date of Patent: Apr. 9, 2019

(54) PLASMA FIRED STEAM GENERATOR SYSTEM

(71) Applicant: PYROGENESIS CANADA INC., Montreal (CA)

(72) Inventors: Lakshminarayana Rao, Ashoknagar (IN); Pierre Carabin, Montreal (CA); Jean-Rene Gagnon, Boisbriand (CA); William Kreklewetz, Pointe-Claire (CA)

(73) Assignee: PYROGENESIS CANADA INC., Montreal, QC (CA)

( * ) Notice: Subject to any disclaimer, the term of this patent is extended or adjusted under 35 U.S.C. 154(b) by 127 days.

(21) Appl. No.: 15/021,899

(22) PCT Filed: Sep. 12, 2014

(86) PCT No.: PCT/CA2014/000679

§ 371 (c)(1),
(2) Date: Mar. 14, 2016

(87) PCT Pub. No.: WO2015/035502

PCT Pub. Date: Mar. 19, 2015

(65) Prior Publication Data

US 2016/0223188 A1 Aug. 4, 2016

Related U.S. Application Data

(60) Provisional application No. 61/877,150, filed on Sep. 12, 2013.

(51) Int. Cl.
*F22B 1/28* (2006.01)
*F22B 1/30* (2006.01)
(Continued)

(52) U.S. Cl.
CPC ..... *F22B 1/30* (2013.01); *F22B 37/48* (2013.01); *F22B 37/54* (2013.01)

(58) Field of Classification Search
None
See application file for complete search history.

(56) References Cited

U.S. PATENT DOCUMENTS 4,772,775 A 9/1988 Leach
6,536,523 B1 * 3/2003 Kresnyak ..... B01D 1/0047 166/266
(Continued)

FOREIGN PATENT DOCUMENTS

RU 2350836 3/2009

OTHER PUBLICATIONS

International Search Report (PCT/CA2014/000679) dated Jan. 21, 2015.

*Primary Examiner* — Thor Campbell

(57) ABSTRACT

A system for generating high pressure steam from dirty water uses a combination of sub-merged plasma arcs and electrical resistive heating. Dirty water from steam assisted gravity drainage, or other dirty water producing process, which needs to be converted into high pressure steam, is fed directly without any pre-treatment, into a plasma fired steam generator, powered by submerged electrodes. The combination of electric arc plasma and resistive heating is created between the submerged electrodes. The heat so generated will boil the water portion of the dirty water feed to generate steam that is collected in a steam space and then removed there from. The solids and other residues (residual sludge) present in the feed water settle down at the bottom of the steam generator and are removed via a blow-down stream.
(Continued)

The plasma arcs are used to intermittently remove any scaling or solid deposits that can accumulate on the electrodes.

20 Claims, 5 Drawing Sheets

(51) Int. Cl.
*F22B 37/48* (2006.01)
*F22B 37/54* (2006.01)

(56) References Cited

U.S. PATENT DOCUMENTS

| | | | | |
|---|---|---|---|---|
| 2006/0042251 | A1 | 3/2006 | Villalobos | |
| 2011/0154873 | A1* | 6/2011 | Burnham | C05B 17/00 71/8 |
| 2011/0265474 | A1* | 11/2011 | Schubert | C02F 1/048 60/641.9 |
| 2012/0000642 | A1* | 1/2012 | Betzer Tsilevich | B03D 1/02 166/57 |
| 2012/0279903 | A1* | 11/2012 | Tsilevich | E21B 43/24 208/391 |
| 2014/0008208 | A1* | 1/2014 | Pichach | B01D 3/38 203/1 |
| 2015/0362175 | A1* | 12/2015 | Kim | F22B 1/025 122/379 |

* cited by examiner

PLASMA FIRED STEAM GENERATOR SYSTEM

CROSS REFERENCE TO RELATED APPLICATIONS

This Application claims priority on U.S. Provisional Application No. 61/877,150, now pending, filed on Sep. 12, 2013, which is herein incorporated by reference.

FIELD

The subject matter of the present disclosure relates to steam generation.

BACKGROUND

Bitumen contained in ore bodies (oil sands) is recovered using either surface mining with subsequent physical/mechanical recovery unit operations or with an in situ recovery process referred to as Steam assisted gravity drainage (SAGD). About 80-85% of the total oil sands reserves employ the SAGD process. In the SAGD process, steam generated at a centralized boiler house using once through steam generators (OTSG) is transported to oil wells located at distances anywhere between 2 and 10 km. The steam pressure at the OTSG is 10 MPa, while at the inlet of the well it is 4 MPa and inside the well it is 2.5 MPa. The water-oil emulsion recovered from the oil well is then pumped to the central processing facility. Oil and water are separated from this emulsion using knock-out drums. Since environmental regulations require a high recycle ratio of water, the dirty water is re-used using a series of water cleaning unit operations before it can be used as boiler feed water for the OTSGs.

The existing water recovery/steam generation process has drawbacks and limitations that include, but are not limited to, high capital costs, long installation and commissioning times, long start-up and shutdown times and low process availability. The current process is also not economically viable for smaller or isolated well pads.

SUMMARY

It would thus be highly desirable to be provided with a system or method that would at least partially address the disadvantages of the existing technologies.

The embodiments described herein provide in one aspect a steam generating system, which uses a combination of submerged plasma arcs and resistive heating, to generate high pressure steam from dirty feed water.

The embodiments described herein provide in another aspect a plasma fired steam generator, which uses either a single set of electrodes or multiple sets of electrodes to generate high pressure steam from the feed water.

The embodiments described herein provide in another aspect an electrode seal system which can provide the seal between the electrically conducting electrodes and the body of the plasma fired steam generator.

The embodiments described herein provide in another aspect an endless screw mechanism, which can provide great precision, used to control the relative position of the electrically conducting electrodes and thus independently control the current for each AC phase and the power input to a plasma fired steam generator (PFSG).

The embodiments described herein provide in another aspect a plasma fired steam generator, comprising either a single set of electrodes or multiple sets of electrodes to generate high pressure steam from feed water.

The embodiments described herein provide in another aspect an electrode seal system for use between electrically conducting electrodes and a body of a plasma fired steam generator.

The embodiments described herein provide in another aspect an endless screw mechanism for use in controlling a relative position of electrically conducting electrodes and thus independently controlling a current for each AC phase and a power input to a plasma fired steam generator.

The embodiments described herein provide in another aspect a steam generating system, comprising a combination of at least one submerged plasma arc and resistive heating, adapted to generate high pressure steam from dirty feed water.

The embodiments described herein provide in another aspect a method for generating steam, comprising: providing a steam generator; feeding dirty water to the steam generator; and submitting the dirty water to at least one submerged plasma arc and to resistive heating, such as to generate high pressure steam.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

The present system uses a combination of plasma arcs and resistive heating, generated either using alternating current or direct current and submerged under water, to produce steam from untreated (dirty) water. The energy needed to produce steam is provided by the plasma arcs struck between electrically conducting electrodes, as well as the water's electrical resistivity. A high current, low voltage power source, either AC or DC, is used to generate and power the plasma arcs.

In the present system, called the plasma fired steam generator (PFSG) process, the dirty water coming, for example, from the free water knock outs (FWKO) is directly injected into a plasma fired steam generator. The plasma arcs submerged in the water, along with resistive heating, deliver the necessary energy to evaporate water and produce high pressure steam in a continuous manner.

The PFSG functions in a similar way to an electric arc furnace processing scrap steel, but using steel electrodes instead of graphite electrodes, and immersed in water, instead of in a mass of steel scrap. The intense heat of the plasma will vaporize water at a high rate. The main advantage of using plasma over gas or electric heating elements is that the intense heat of the plasma allows the electrodes tips to remain clean, despite the precipitation of solids caused by the evaporation of dirty water. This allows for a high throughput of steam production with a small installation footprint.

For the SAGD applications, the Plasma Fired Steam Generator (PFSG) can be used to produce high pressure (4 MPa) steam from "dirty" water directly at the well pad. This eliminates the costly and sometimes dangerous transportation of high pressure steam over long distances, allows for quick expansion and allows for the use of brackish water as a make-up water source when required.

Furthermore, the PFSG can be built in modular sections, allowing for installation at a single well, or for an entire well pad, as required.

Figure 1:
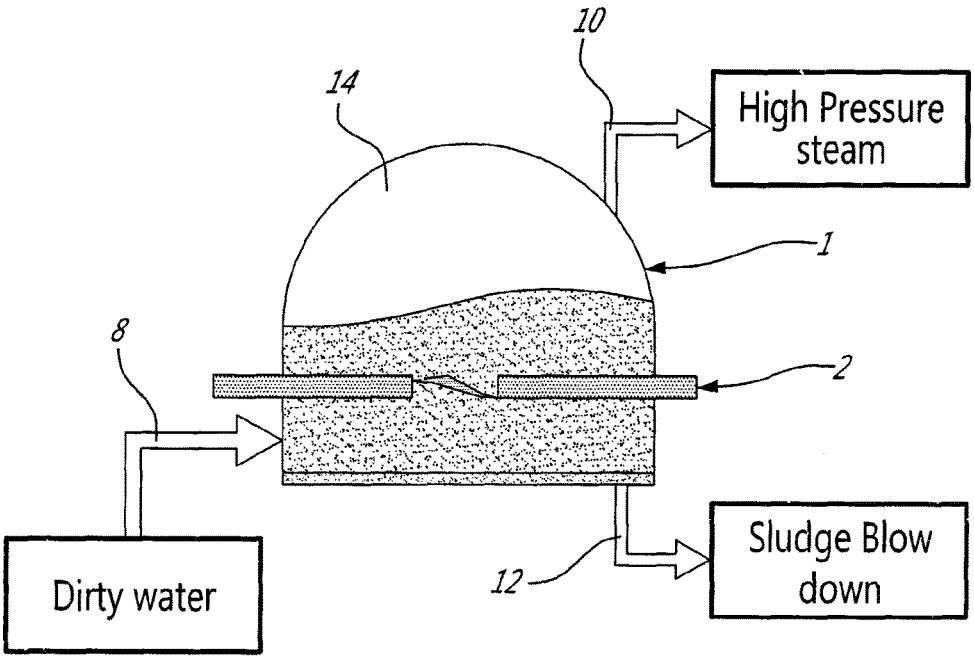
FIG. 1 shows a schematic representation of a plasma fired steam generator (PFSG) system according to one of various exemplary embodiments.

As shown in FIG. 1, the dirty water used to produce steam is fed, via a feed inlet 8, to a plasma fired steam generator (PFSG) 1, powered by submerged electrodes 2. The water portion of the feed is evaporated to form steam, whereas the solid portion settles at the bottom of the steam generator 1. The steam generated is removed via a steam outlet 10 from the steam space, and the residual sludge is removed as a blowdown stream via a residue outlet 12. The plasma arcs are used to intermittently remove any scaling or solid deposits that can accumulate on the electrodes. A vessel of the PFSG 1 is generally denoted by reference 14.

Therefore, dirty water from the Steam Assisted Gravity Drainage (SAGD), or other dirty water producing process, which needs to be converted into high pressure steam, is fed typically directly without any pretreatment into the plasma fired steam generator (PFSG) 1. A combination of electric arc plasma and resistive heating is created between the submerged electrodes 2. The heat so generated will boil the water to generate steam which is collected in the steam space. The solids and other residues present in the feed water settle down at the bottom of the (PFSG) 1, and are removed via a blowdown stream.

Figure 2A:
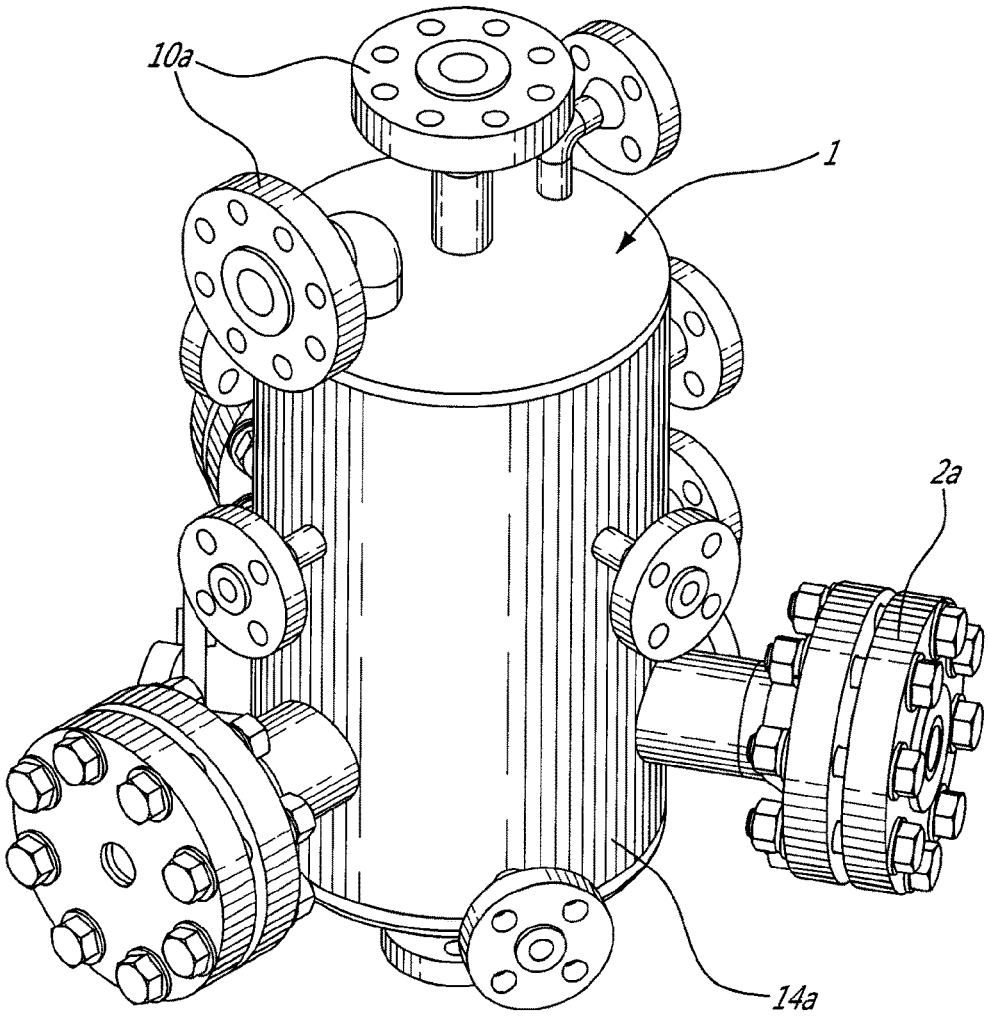
FIGS. 2*a* and 2*b* show schematic representations of the PFSG with a single set of electrodes and with multiple sets of electrodes, respectively.
Figure 2B:
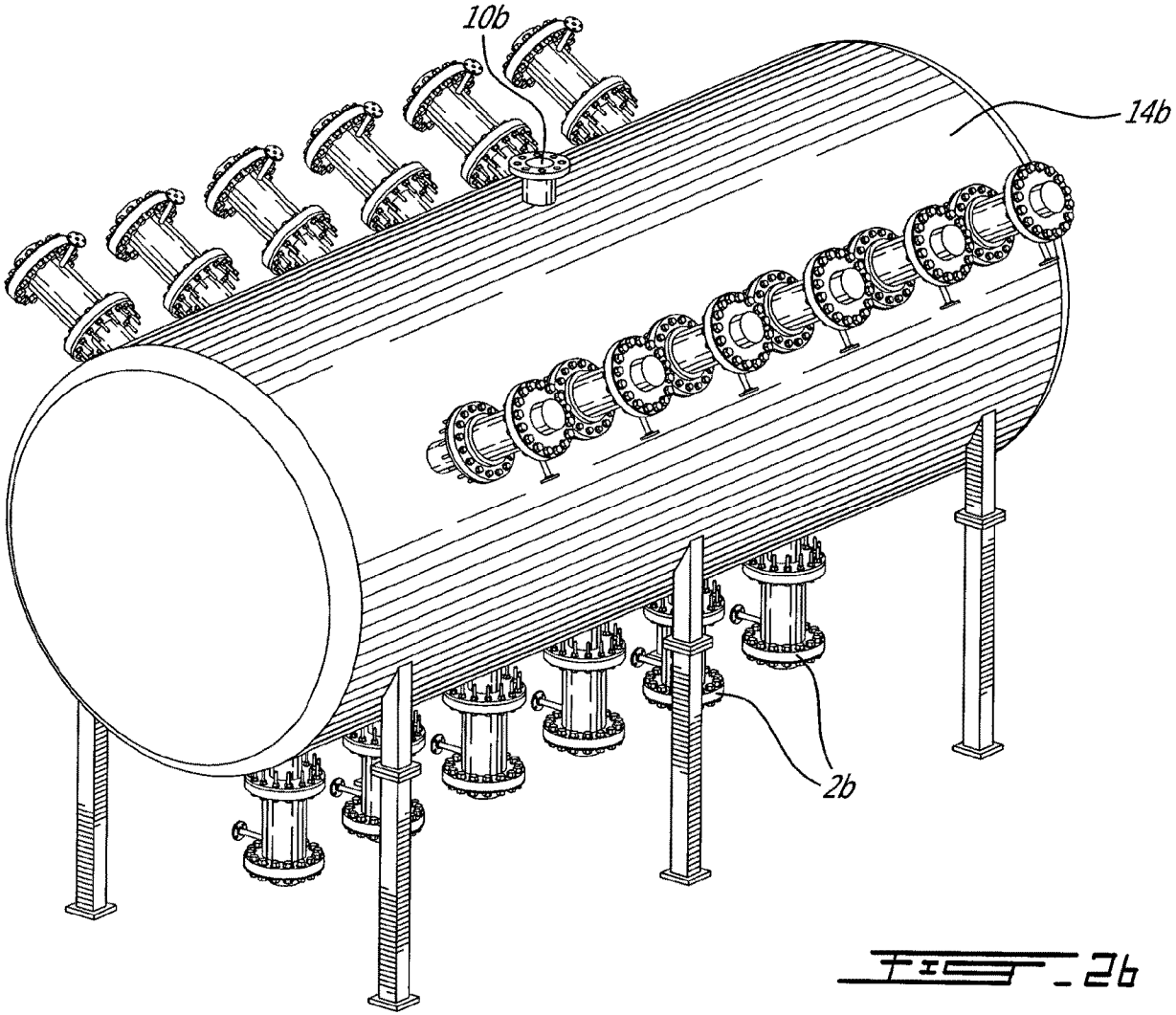

FIGS. 2*a* and 2*b* show the electrode arrangement for the PFSG 1 with a single set of electrodes and multiple sets of electrodes, respectively. To achieve higher steam throughput, PFSGs 1 equipped with multiple sets of electrodes are used, whereas smaller throughput steam generators 1 use only a single set of electrodes.

In the 3 phase AC arrangement with a single set of electrodes illustrated in FIG. 2*a*, the PFSG includes a vertical steel cylindrical vessel 14*a* with spherical ends designed to meet the appropriate requirements for steam pressure vessels. The three alternating current (AC) electrodes are located, for instance, midway up the reactor's sidewall and are positioned at 120 degrees from each other. A steam outlet 10*a* is located, for instance, at the top of the reactor.

In the multiple set of electrodes 3 phase AC arrangement of FIG. 2*b*, the reactor includes a horizontal steel cylinder 14*b* with spherical ends, which meets the appropriate requirements for steam pressure vessels. The AC electrodes are installed, for example, as 6 trios (the electrodes of each trio being positioned at 120 degrees from one another about the reactor's circumference), for a total of 18 electrodes. A steam outlet 10*b* is located, for instance, in the middle of the reactor, with three sets of electrodes on each side. For larger capacity PFSGs 1, additional sets of electrodes would be provided. For smaller capacity PFSGs 1, between 2 and 6 sets of electrodes would be used.

Figure 3:
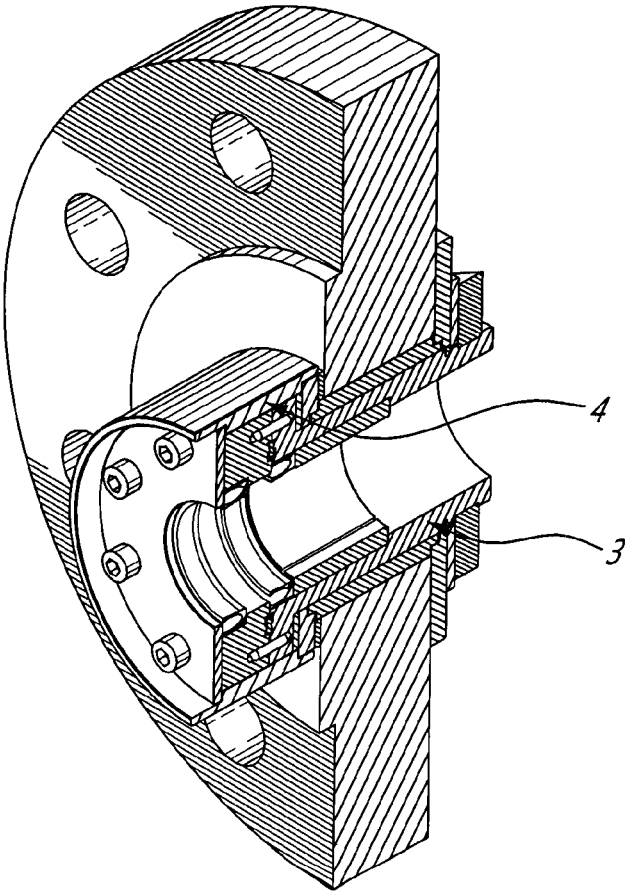
FIG. 3 shows a schematic representation of electrode seals, which are used to seal a gap between a current carrying electrode and a body of the PFSG.

An electrically insulating, high pressure seal mechanism is used to seal a gap between the current carrying electrodes 2 and a body of the PFSG 1, as shown in FIG. 3. To maintain electrical insulation and thus avoid a flow of electric current through the body of the PFSG 1, electrically insulating plates 3 and sleeves 4 are used.

In the AC mode of operation, the power input to the PFSG 1 is controlled by varying the power supply voltage set-point and also by varying the relative position of the electrodes with each other. Varying the position of the electrodes relative to each other allows for controlling the current, and consequently the total power input.

In the DC mode of operation, the power input to the PFSG 1 is controlled by varying the power supply current set-point and also by varying the relative position of the electrodes with each other. Varying the position of the electrodes relative to each other allows for controlling the voltage, and consequently the total power input.

Figure 4:
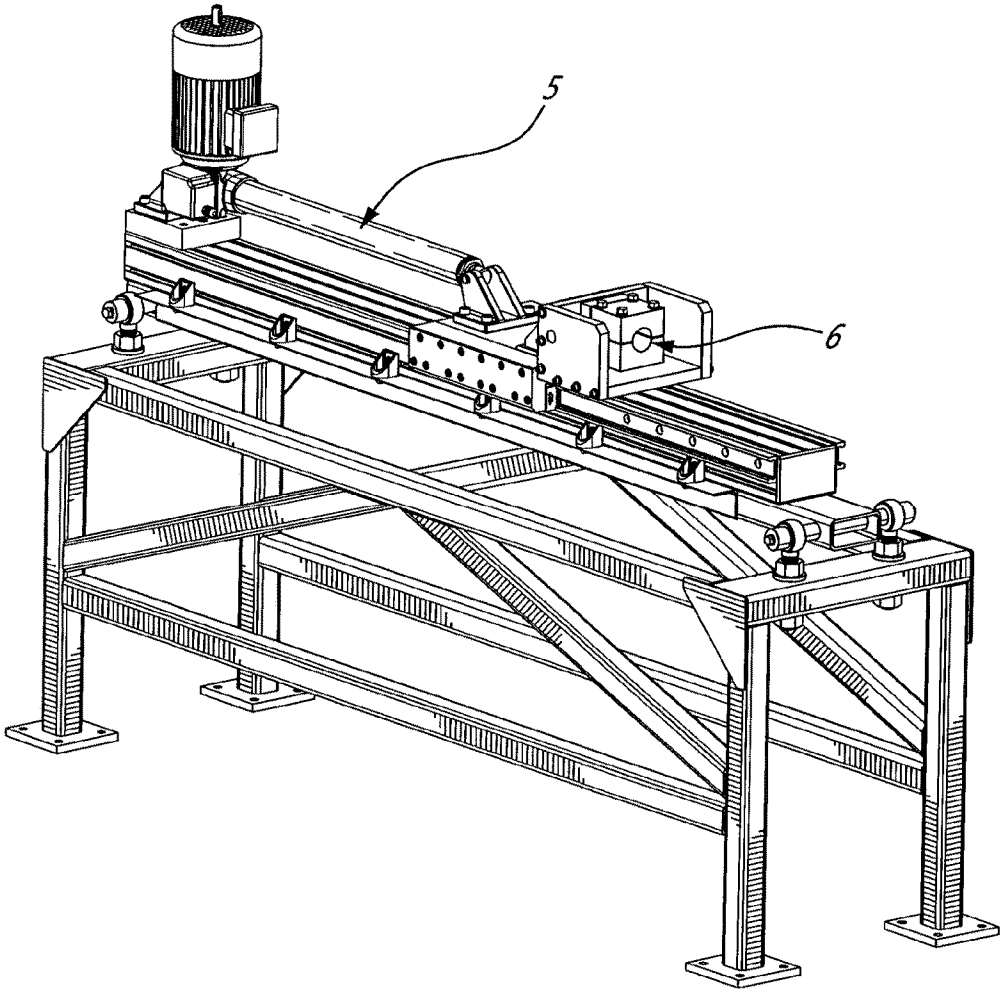
FIG. 4 shows a schematic representation of an electrode motion system.

The electrodes of the PFSG 1 are moved using an electrode motion system, for example an endless screw mechanism 5, as shown in FIG. 4, which can be controlled with great precision and can maintain the electrode positions against the force of the high pressure steam. Electrode clamps 6 are fabricated from electrically conductive materials and, as they clamp onto the electrodes, they provide the necessary contact for the flow of electric current.

Although the application mentioned hereinabove of the present Plasma Fired Steam Generator (PFSG) 1 is for the extraction of bitumen from the oil sands, it is however noted that the PFSG can be used in any industrial processes where a source of dirty water must be purified before conversion to steam at low or high pressure.

Finally, while the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

The invention claimed is:

1. A method for generating steam, comprising:
providing a steam generator;
feeding dirty water to the steam generator; and
submitting the dirty water to at least one submerged plasma arc and to resistive heating, such as to generate high pressure steam, wherein an endless screw mechanism is provided for controlling a relative position of electrically conducting electrodes and thus independently controlling a current for each AC phase and a power input to the steam generating system.

2. The method of claim 1, further comprising the step of removing the high pressure steam from the steam generator.

3. The method of claim 1, further comprising the step of removing a residual sludge from the steam generator.

4. The method of claim 1, wherein the dirty water is obtained from steam assisted gravity drainage, or another dirty water producing process.

5. The method of claim 1, wherein the dirty water is fed directly without any pre-treatment into the steam generator.

6. The method of claim 1, wherein there are provided a plurality of submerged electrodes.

7. The method of claim 1, wherein a combination of electric arc plasma and resistive heating is created between submerged electrodes.

8. The method of claim 1, wherein the heat generated is adapted to boil a water portion of the dirty water to generate the high pressure steam.

9. The method of claim 1, wherein the high pressure steam is collected in a steam space and is then removed therefrom.

10. The method of claim 1, wherein solids and other residues (residual sludge) present in the dirty water settle down at a bottom of the steam generator and are removed via a blow-down stream.

11. The method of claim 1, wherein the plasma arcs are used to intermittently remove scaling or solid deposits that may have accumulated on the electrodes.

12. A plasma fired steam generator, comprising either a single set of electrodes or multiple sets of electrodes to generate high pressure steam from feed water, and including an endless screw mechanism for use in controlling a relative position of the electrodes and thus independently controlling a current for each AC phase and a power input to the steam generator.

13. A steam generating system, comprising a combination of at least one submerged plasma arc and resistive heating, adapted to generate high pressure steam from dirty feed water, an endless screw mechanism being provided for controlling a relative position of electrically conducting electrodes and thus independently controlling a current for each AC phase and a power input to the steam generating system.

14. The steam generating system of claim 13, comprising a vessel, at least one inlet to the vessel for feeding the dirty feed water therein, and at least one first outlet for removing the high pressure steam from the vessel.

15. The steam generating system of claim 13, comprising at least one second outlet for removing solids and other residues from the vessel.

16. The steam generating system of claim 13, wherein there are provided a plurality of submerged plasma arcs.

17. The steam generating system of claim 13, wherein the electrically conducting electrodes include either a single set of electrodes or multiple sets of electrodes to generate the high pressure steam from the dirty feed water.

18. The steam generating system of claim 13, wherein there is provided an electrode seal system between the electrically conducting electrodes and a body of the vessel.

19. The steam generating system of claim 18, wherein electrically insulating plate(s) and sleeve(s) are provided to maintain electrical insulation and thus avoid a flow of electric current through the body of the vessel.

20. The steam generating system of claim 13, wherein the steam generating system includes a plasma fired steam generator.

* * * * *